US005809576A

United States Patent [19]

Huston et al.

[11] Patent Number: 5,809,576

[45] Date of Patent: Sep. 22, 1998

[54] ATTACHABLE POCKET

[75] Inventors: Diana M. Huston, Okeechobee, Fla.; J. Terese Martin, 1634 NW. 128 Ave., Okeechobee, Fla. 34972

[73] Assignee: J. Terese Martin, Okeechobee, Fla.

[21] Appl. No.: 859,155

[22] Filed: May 20, 1997

[51] Int. Cl.[6] ..... A41D 27/20

[52] U.S. Cl. ..... 2/247; 2/248; 2/275

[58] Field of Search ..... 2/247, 248, 249, 2/250, 251, 252, 253, 67, 73, 903, 75, 80, 83, 94, 105, 106, 69, 69.5

[56] References Cited

U.S. PATENT DOCUMENTS

| | | | |
|---|---|---|---|
| 3,137,865 | 6/1964 | Evans et al. . | |
| 3,611,444 | 10/1971 | Rector | 2/247 |
| 3,840,901 | 10/1974 | Eyster | 2/247 |
| 4,218,781 | 8/1980 | Lieberman | 2/247 |
| 4,321,710 | 3/1982 | Off . | |
| 4,349,920 | 9/1982 | Off . | |
| 4,357,197 | 11/1982 | Wilson . | |
| 4,549,916 | 10/1985 | Off et al. . | |
| 4,602,390 | 7/1986 | Morera et al. | 2/247 X |
| 4,656,673 | 4/1987 | Easton et al. . | |
| 4,748,996 | 6/1988 | Combier | 2/903 X |
| 4,899,395 | 2/1990 | Spector | 2/247 X |
| 4,924,613 | 5/1990 | Lewis | 2/247 |
| 5,031,244 | 7/1991 | Inagaki | 2/94 X |
| 5,173,968 | 12/1992 | Fox | 2/247 X |
| 5,367,706 | 11/1994 | Davidson | 2/4 |

*Primary Examiner*—Jeanette E. Chapman
*Attorney, Agent, or Firm*—Charles J. Prescott

[57] ABSTRACT

An iron on pocket for a shirt and other articles of clothing including a piece of flexible screen mesh material in the shape of a pocket and having a mesh size sufficiently large to permit viewing of the pattern and coloring of the clothing material and for easy water drainage and drying when used for a swimwear garment pocket. A separate strip of fabric may be attached centrally along the top margin of the pocket to define an eyeglass stem receiving loop for retaining a pair of eyeglasses. An alternate embodiment utilizes two part hook and loop material such as VELCRO for attachment of the pocket to other substrates.

7 Claims, 6 Drawing Sheets

32
24
28
12
16
26
34
30
20

42
12
36
38
32
40
44
24
26
34
20

FIG. 5
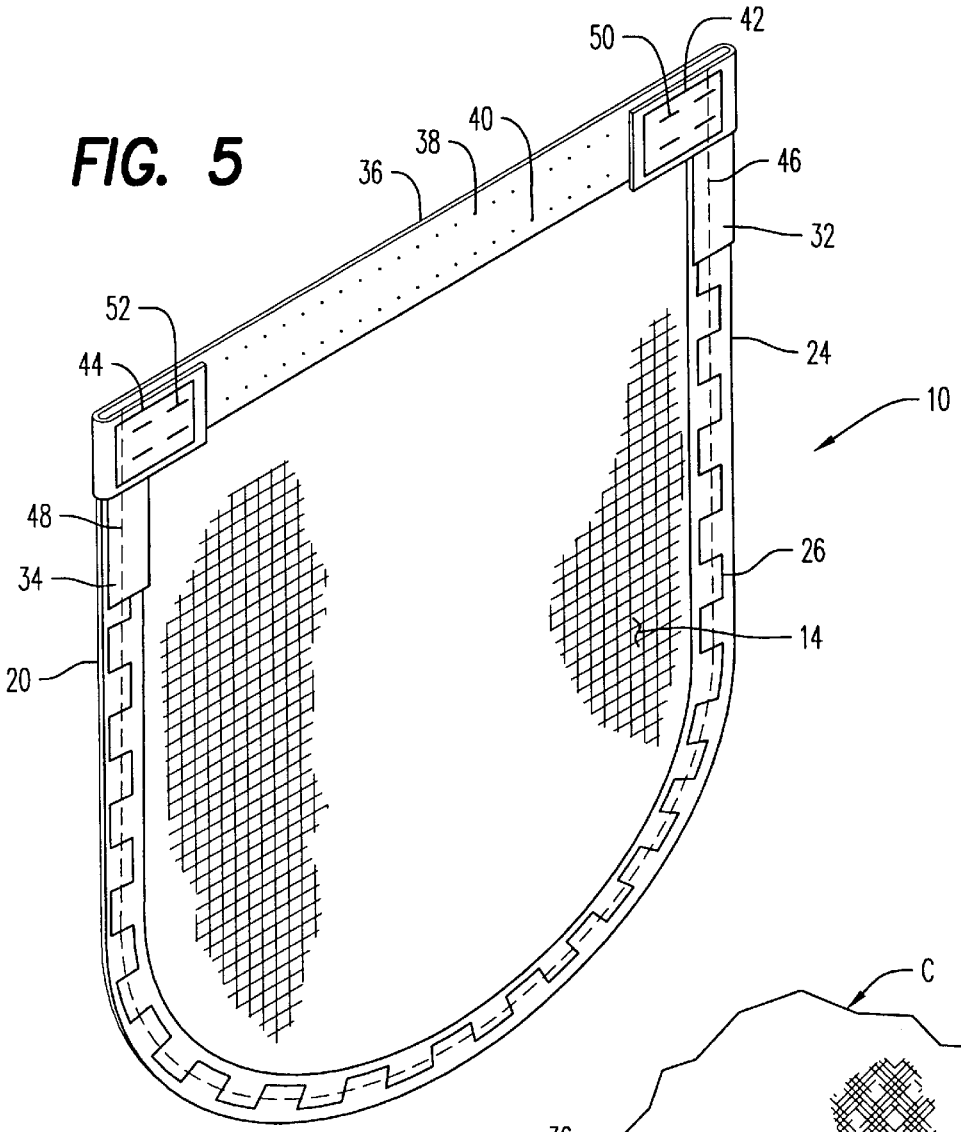
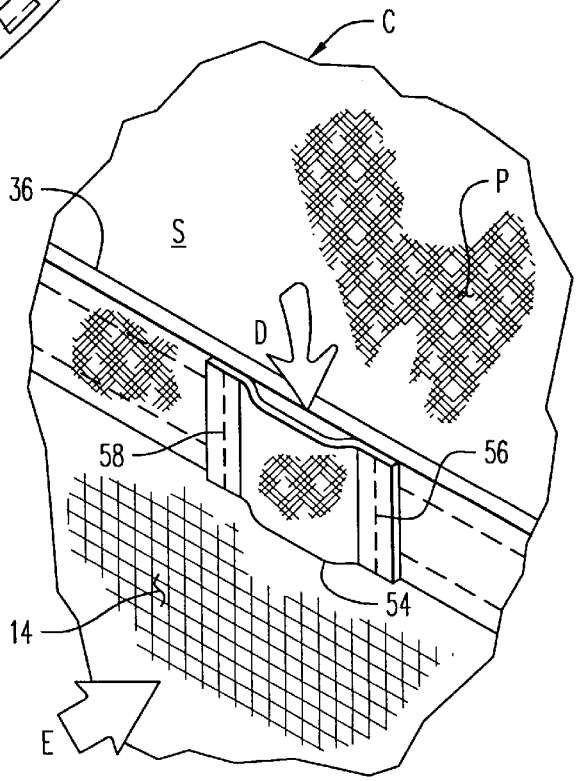
FIG. 6

ATTACHABLE POCKET

BACKGROUND OF THE INVENTION

1. Scope of Invention

This invention relates generally to pockets for articles of clothing, and more particularly to an iron on pocket with thermal active adhesive strips along side and bottom margins for attachment to a preselected clothing surface and to an alternate embodiment which is attachable to other substrates.

2.Prior Art

Typically, pockets for articles of clothing such as shirts, pants, other sportswear and swimsuits are attached at manufacture by sewing the pocket material directly to the preselected clothing surface by conventional stitching. However, for those articles of clothing which are not manufactured with pockets at all, or include sewn in place pockets in less than ideal locations on the clothing, an "after market" pocket which is easy to attach is desirable.

U.S. Pat. No. 4,656,673, invented by Easton, teaches an iron on pocket similar to that of the present invention which is made of fabric and carries an emblem is attachable by applying a preheated iron to the side and bottom margins of this pocket for permanent attachment over a preselected surface of the article of clothing.

Evans, in U.S. Pat. No. 3,137,865 also teaches an adhesively formed and attached garment pocket which eliminates the need for conventional stitching for attachment to an article of clothing.

A patch pocket and flap construction is taught by Off in U.S. Pat. No. 4,549,916 which includes adhesive means for its attachment to an article of clothing.

The following additional patents are known to applicant to be associated with the permanent bonding of a pocket shaped fabric material to articles of clothing as follows:

| | |
|---|---|
| U.S. Pat. No. 4,357,197 | Wilson |
| U.S. Pat. No. 4,321,710 | Off |
| U.S. Pat. No. 4,349,920 | Off |

The present invention provides an iron on pocket for thermal activation of adhesive fabric strips along the side and bottom margins thereof by applying pressure from a preheated iron thereto against the preselected surface of the article of clothing. However, the pocket itself is made of preferably fiberglass screen mesh material having a mesh size of, preferably in the range of about 16 so as to be sufficiently large to allow the viewability of the color and pattern of the underlying clothing fabric. Additionally, when the present invention is utilized in conjunction with boating or swimsuit garments, water will quickly drain from the pocket when the wearer comes out of the water for quicker drying of both the swimsuit and any contents in the pocket.

BRIEF SUMMARY OF THE INVENTION

This invention is directed to an iron on pocket for a shirt and other articles of clothing including a piece of flexible screen mesh material in the shape of a pocket and having a mesh size sufficiently large to permit viewing of the pattern and coloring of the clothing material and for easy water drainage and drying when used for a swimwear garment pocket. A separate strip of fabric may be attached centrally along the top margin of the pocket to define an eyeglass stem receiving loop for retaining a pair of eyeglasses. An alternate embodiment utilizes two part hook and loop material such as VELCRO for attachment of the pocket to other substrates.

It is therefore an object of this invention to provide an iron on pocket for an article of clothing which is fabricated of flexible screen mesh material.

It is still another object of this invention to provide an iron on pocket which will not substantially block the viewability of the underlying color and pattern of the article of clothing.

It is yet another object of this invention to provide an iron on pocket for swimwear which will quickly drain of water and dry.

Still another object of the invention is to provide an iron on pocket which is more economical in construction and does not reduce the pocket opening size at the corners from that of the full width of the overall pocket inside width itself.

Another object of this invention is to provide a pocket which is easily attachable to other substrates by two-part hook and loop material.

In accordance with these and other objects which will become apparent hereinafter, the instant invention will now be described with reference to the accompanying drawings.

BRIEF DESCRIPTION OF THE DRAWINGS

FIG. 5 is a perspective view of the obverse or outwardly facing surface of the completed iron on pocket of the present invention.

FIG. 6 is an enlarged view of the top margin of a portion of the opening of the invention as shown in FIG. 5.

DETAILED DESCRIPTION OF THE INVENTION

Figure 1:
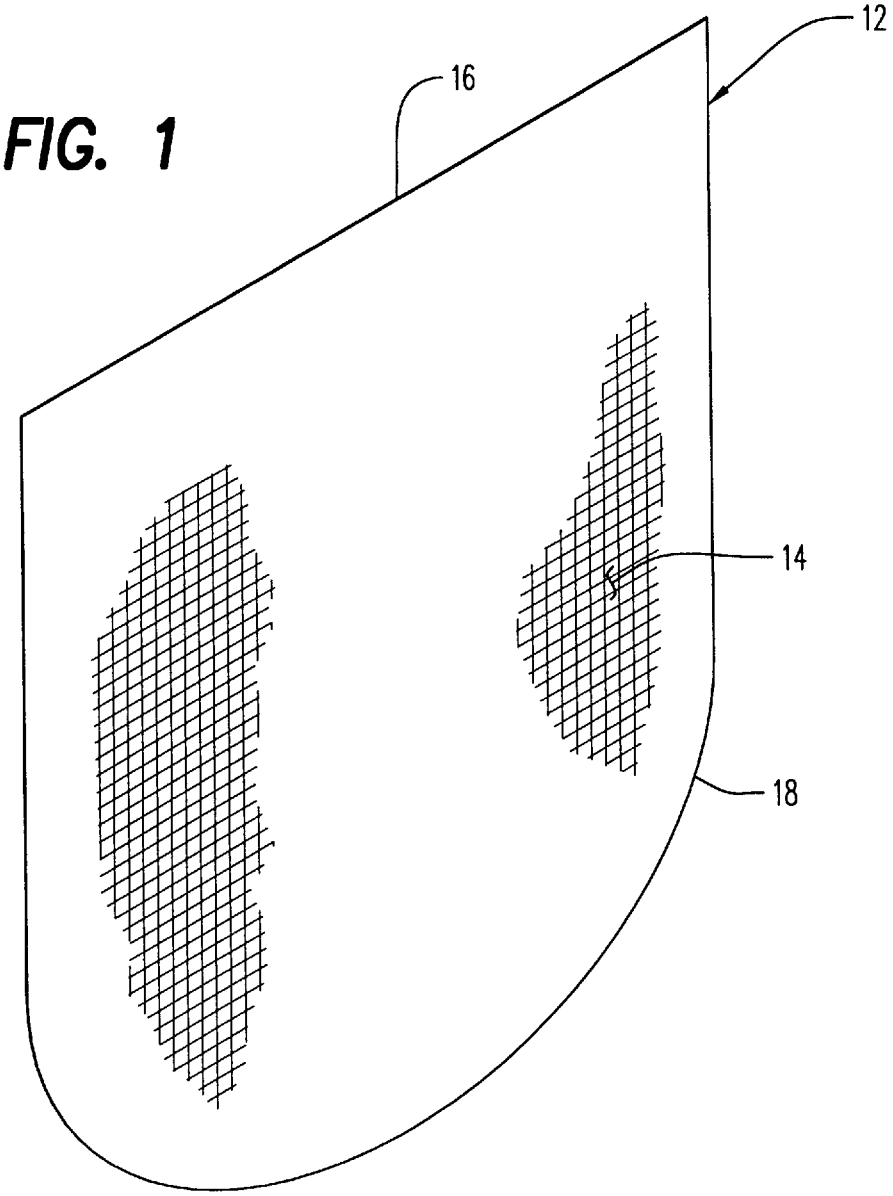
FIG. 1 is a perspective view of the reverse side of a sheet of flexible screen mesh material to be utilized in constructing the iron on pocket as a preferred embodiment of the present invention.

Referring now to the drawings, the preferred embodiment of the invention is shown generally at numeral 10 in FIG. 5, the sequence of manufacture or assembly thereof depicted for clarity in FIGS. 1 to 4.

In FIG. 1, the manufacture of the iron on pocket 10 of FIG. 5 begins with the cutting of a sheet of screen mesh material 12 into the shape of the desired iron on pocket. Thus, side and bottom margins shown generally at 18 and top margin 16 are there defined. The preferred screen mesh material, shown at 14, is of a mesh size sixteen and is formed of fiberglass screen material.

This mesh size is selected to accomplish one or both of two objects of the invention. The first object is to minimize the visual impedance of the underlying pattern and coloring of the article of clothing to which the iron on pocket 10 is to be attached. Thus, only one color version of this iron on pocket (black) needs to be provided in the marketplace. Because the color of the screen mesh material 14 is neutral and does not impede the viewability of the underlying material forming the article of clothing to which the iron on pocket 10 is to be attached, the only variation for market purposes is the size and shape of the pocket itself.

A second object of the invention is satisfied by the utilization of the flexible fiberglass screen mesh material 14 in conjunction with swim wear. When the iron on pocket of the present invention is utilized for such articles of clothing, water will quickly drain from the pocket, shortening drying time of the underlying swim wear material and any contents held within the pocket.

Note that the preferred screen mesh size of 16 may be varied substantially within the scope of this invention so long as one or both of these objects are substantially met.

Figure 2:
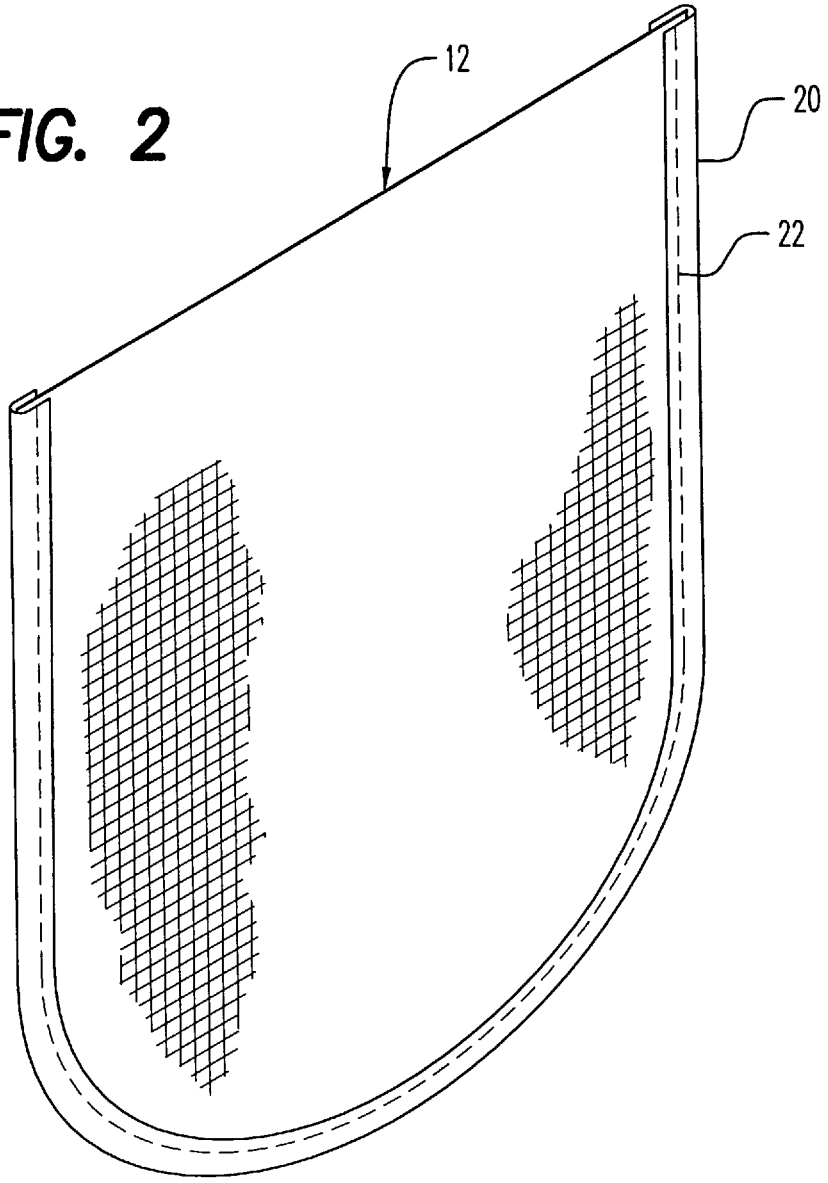
FIG. 2 is a perspective view of FIG. 1 showing the addition by stitching in place of a length of double-seam binding material wrapped around and along the side and bottom margins as a further manufacturing step.

Referring next to FIG. 2, the next step in manufacture is to attach an elongated length of double-seam binding material 20 over and along the side and bottom margins shown generally at 18 of the pocket 12. Attachment is by conventional stitching along 22.

Figure 3:
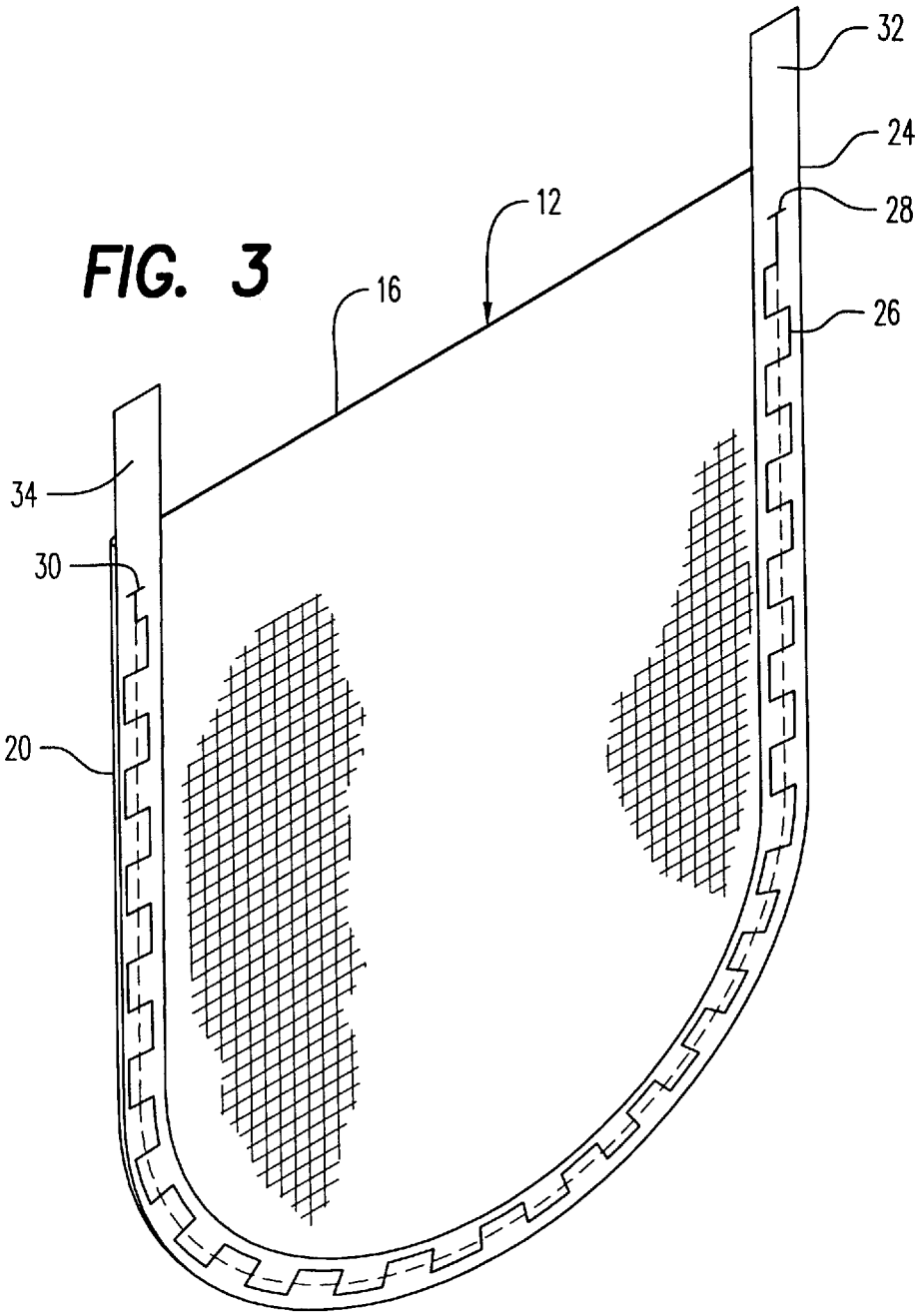
FIG. 3 is a view of FIG. 2 showing the addition by stitching in place of an elongated narrow strip of thermal active adhesive fabric along the side and bottom margins of the reverse surface of the pocket as a further step in the manufacturing thereof.

In FIG. 3, a length of iron on fabric adhesive 24 is sewn in place by stitching along 26 atop the reverse side of the double-seam binding material 20. The preferred form of stitching 26 is an overcast stitch atop a straight stitch as shown to insure adequate adhesion strength. This iron on fabric adhesive 24 is available under the trade name STITCH WITCHERY from the Dritz Company in N.C. Note that the iron on fabric adhesive 20 extends at 32 and 34 above the top margin 16 and that the stitching terminates at 28 and 30 below the top margin 16, the purpose of which is described herebelow.

Figure 4:
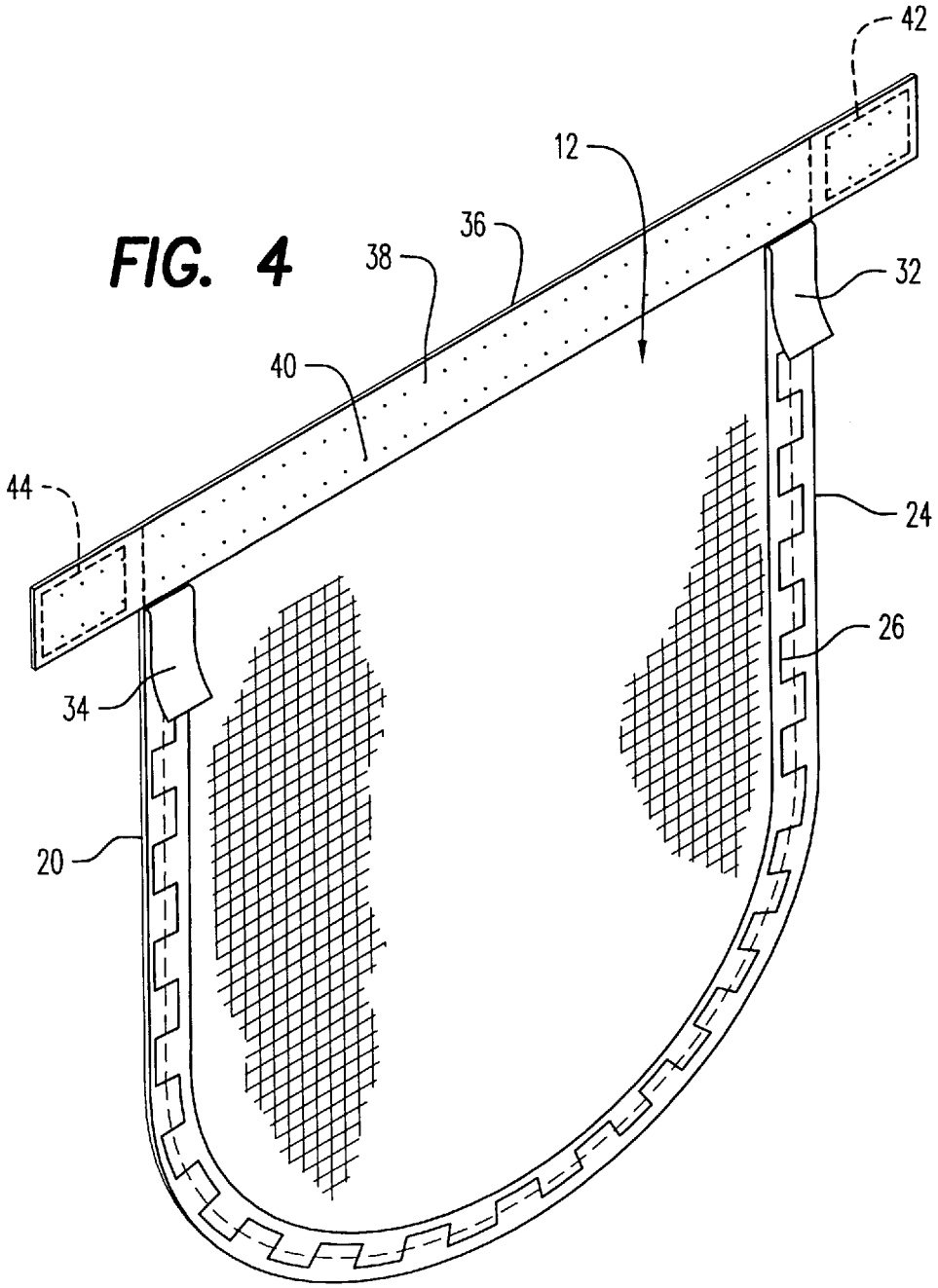
FIG. 4 is a perspective view of FIG. 3 showing the addition of a length of double-seam binding material wrapped around and along the top edge of the pocket and stitched in place as a further step of manufacture thereof.

A next step of manufacture is shown in FIG. 4 wherein a second length of double-seam binding material 36 is attached by double row stitching at 38 and 40 around and along and concealing the top margin 16 of the pocket 12. The distal unattached ends 32 and 34 of the fabric adhesive 24 have been folded downwardly to facilitate attachment of the binding material 36. Two patches of iron on fabric adhesive 42 and 44 attached by stitching to the opposite or obverse surface of the distal end portions of binding material 36 shown in hidden lines.

The ready to use iron on pocket is shown at 10 in FIG. 5. The distal unattached end portions 32 and 34 of the iron on fabric adhesive are secured by stitching along 46 and 48, while the distal end portions of the binding material 36 are folded over and attached and held in place by stitching along 50 and 52 so as to be facing reversely toward the clothing material along with fabric adhesive strap 24 to which the pocket 10 will be adhesively attached.

Note that stitching along 46 and 48 which extends upwardly to attach binding material end portions 42 and 44 allows the main portion of the binding material 36 which extends along substantially the entire upper margin 16 of pocket material 12 to remain free and unattached to the article of clothing along the entire width of the pocket opening between the end portions 32 and 34 of the fabric adhesive 24.

Referring to FIG. 6, the obverse or exposed surface of the iron on pocket 10 of FIG. 5 is shown attached to a preselected surface S of an article of clothing C. A fabric loop 54 is also attached by spaced stitching 56 and 58 to the exposed surface of binding material 36. This fabric loop 54 is for receiving one stem of a pair of eyeglasses downwardly in the direction of the arrow D for supportive retention of the eyeglasses themselves, which may be positioned either on the inside or the outer surface of the pocket 10.

Note in FIG. 6 that the fabric pattern P and coloring of the article of clothing C is viewable in the direction of arrow E through the screen mesh material 14 as previously described.

Figure 7:
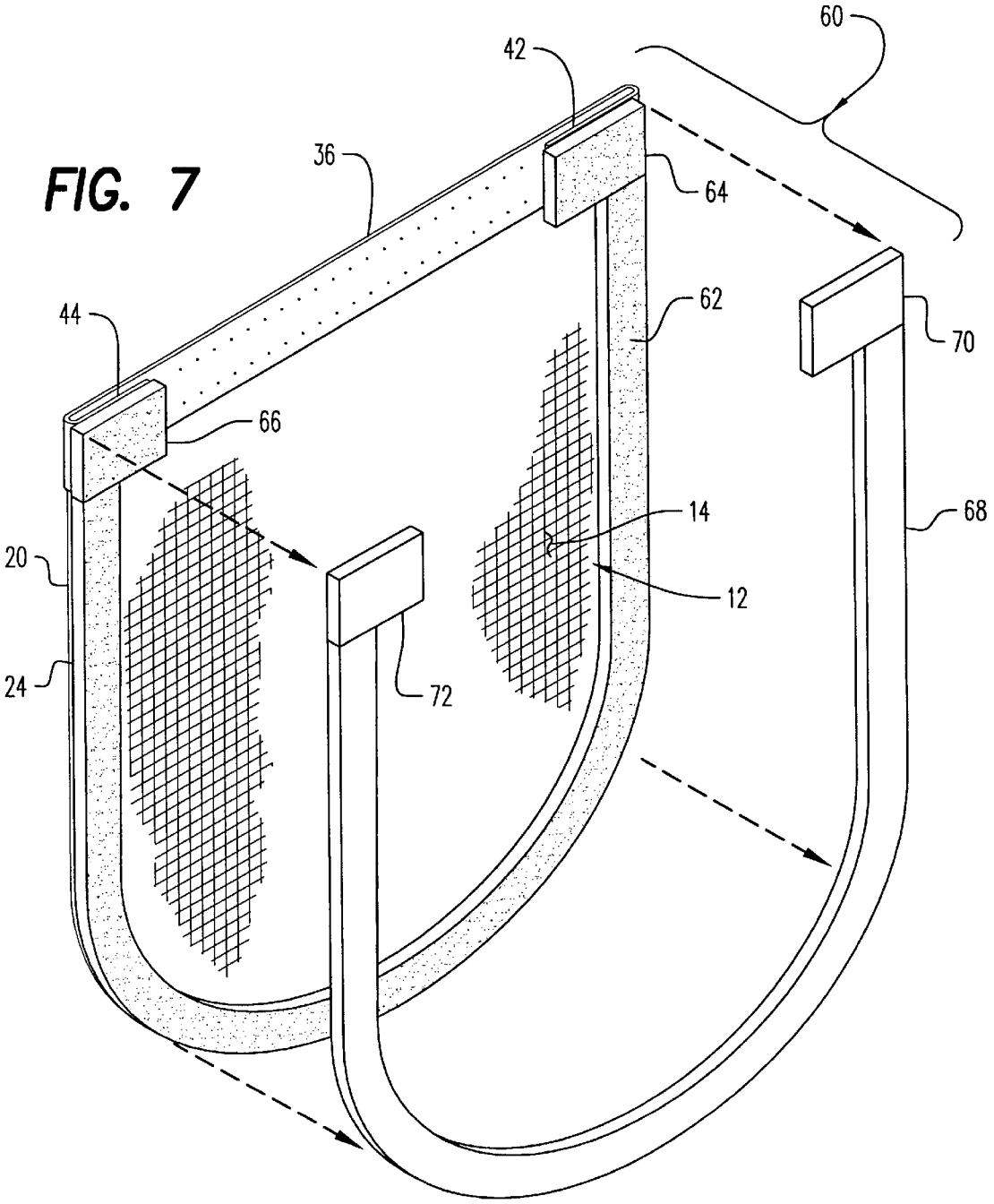
FIG. 7 is an exploded perspective view of another embodiment of the invention which is releasably attachable to other substrates.

Referring lastly to FIG. 7, an alternate embodiment of the invention is shown generally at numeral 60 which is releasably attachable to a substrate surface including an article of clothing or any other surface to which the pocket 60 is to be attached. This embodiment 60 includes a piece of pocket material 12 which is formed of flexible fiberglass screen mesh material 14 having a mesh size of 16 as a preferred embodiment thereof. This embodiment 60 also includes the double-seam binding material strips 24 and 36 stitched in place as previously described. The end portions 42 and 44 of the binding material 36 are doubled over and stitched in place along stitching 46 and 48 as seen in FIG. 5.

In lieu of iron on fabric adhesive, however, elongated strips 62 and 68 of releasably attachable hook and loop fabric material are utilized. The fabric strip portion 62 of the two part attaching arrangement is adhered by adhesive backing thereof along the side and bottom margins of the pocket material 12 as shown. Additional fabric patches 64 and 66 are also adhesively attached to the exposed obverse surface of binding material end portions 42 and 44 as previously described. The adhesive baking of the hook material 68, which is formed into the same mating aligned configuration as that of the fabric portion 62, is adhesively attachable to a substrate such as an article of clothing, a front panel of the refrigerator, a wall, a bulletin board, a tool box or other surfaces to which the pocket 60 is to be releasably attached. By this arrangement, the pocket material 12 may be easily attached to virtually any surface, the benefits of the screen mesh pocket material 14 being as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An iron on pocket for an article of clothing consisting of:

a single piece of flexible screen mesh material having a shape of a pocket with top, bottom and side margins;

adhesive strip means connected to and extending along substantially all of said bottom and side margins which is responsive to the application of heat when being pressed against a preselected surface of the article of clothing for adhesively bonding said pocket to the article of clothing;

said adhesive strip means connected to said screen mesh material by an overcast stitch generally coextensive with a straight stitch to insure adequate attaching strength between said adhesive strip means and said screen mesh material;

said screen mesh material having a mesh or screen size sufficiently large to allow the color and pattern of the preselected surface of the article of clothing to remain viewable through said open mesh material.

2. An after-market pocket adapted to be secured to a preselected surface of an article of clothing after its manufacture, comprising:

a piece of pocket material having a pocket shape and formed of flexible screen material which defines top, side and bottom margins;

elongated strip attaching means connected to and extending along substantially all of said side and bottom margins for securing said pocket material to the preselected surface of the article of clothing;

said adhesive strip means connected to said screen mesh material by an overcast stitch generallv coextensive with a straight stitch to insure adequate attaching strength between said adhesive stop means and said screen mesh material;

said screen material having a mesh size sufficiently large so as to avoid blocking the pattern and color of the preselected surface from view.

3. A pocket as set forth in claim 2 wherein said attaching means comprises:

thermally activated fabric adhesive which is connected along aid side and bottom margins and which adhesively bonds to the article of clothing when heat is applied thereto as by a preheated clothing iron.

4. A pocket as set forth in claim 2 wherein said attaching means comprises:

mateably attachable two-part hook and loop fabric material, one portion of which is attached to, and extending along, said side and bottom margins;

another portion of said two part hook and loop material being adhesively connectable to the preselected surface whereby said pocket is removably attachable thereto.

5. A pocket as set forth in claim 2, further comprising:

an eyeglass retaining loop connected along said top margin and sized to supportively receive a stem of a pair of eyeglasses, the eyeglasses being simultaneously inserted into said pocket.

6. An iron on pocket for a shirt formed of shirt material, said pocket comprising:

a piece of pocket material having a pocket shape and formed of flexible screen mesh material, said pocket material having top, side and bottom margins and an obverse or front surface and a reverse or rear surface which is adapted to be operably disposed against the shirt material;

attaching means connected by stitching to and extending narrowly along said side and bottom margins for adhesively bonding said side and bottom margins to the shirt material when heat and pressure are applied thereto;

said stitching including an overcast stitch in combination with a straight stitch to insure adequate attaching strength between said attaching means and said screen mesh material:

said screen mesh material having a mesh size sufficiently large to permit viewing of the shirt material therethrough.

7. A pocket as set forth in claim 6, further comprising:

an eyeglass retaining loop connected along said top margin and sized to supportively receive a stem of a pair of eyeglasses, the eyeglasses being simultaneously inserted into said pocket.

* * * * *